US008613165B2

(12) United States Patent
Bleil et al.

(10) Patent No.: US 8,613,165 B2
(45) Date of Patent: Dec. 24, 2013

(54) MULTI-CONFIGURATION HIP AND RIDGE SHINGLE

(75) Inventors: Shane Bleil, Pittsfield, MA (US); Scott Kazura, Toledo, OH (US); Gary Tibbetts, Lenox, MA (US)

(73) Assignee: Sampco Companies, Inc., Pittsfield, MA (US)

( * ) Notice: Subject to any disclaimer, the term of this patent is extended or adjusted under 35 U.S.C. 154(b) by 394 days.

(21) Appl. No.: 12/914,529

(22) Filed: Oct. 28, 2010

(65) Prior Publication Data

US 2011/0126485 A1 Jun. 2, 2011

Related U.S. Application Data

(60) Provisional application No. 61/255,880, filed on Oct. 29, 2009.

(51) Int. Cl.
*E04D 1/30* (2006.01)

(52) U.S. Cl.
USPC ..... 52/43; 52/276; 52/277; 52/57; 52/748.1; 156/204; 156/227; 156/226

(58) Field of Classification Search
USPC ..... 52/57, 518, 553–554, 560, 555, 52/526–528, 748.1, 540, DIG. 16, 41–43, 52/87, 90.2, 276–278, 523, 545, 557, 559; D25/140–141; 156/204–227
See application file for complete search history.

(56) References Cited

U.S. PATENT DOCUMENTS

| | | | | | |
|---|---|---|---|---|---|
| 3,913,294 | A | * | 10/1975 | Freiborg | 52/518 |
| 4,187,650 | A | * | 2/1980 | Poplin | 52/57 |
| 4,322,928 | A | * | 4/1982 | Freiborg | 52/521 |
| 4,434,589 | A | * | 3/1984 | Freiborg | 52/57 |
| 4,439,955 | A | * | 4/1984 | Freiborg | 52/57 |
| 5,094,042 | A | * | 3/1992 | Freborg | 52/57 |
| 5,247,771 | A | | 9/1993 | Poplin | |
| 5,365,711 | A | | 11/1994 | Pressutti et al. | |
| 5,375,388 | A | * | 12/1994 | Poplin | 52/560 |
| 5,377,459 | A | * | 1/1995 | Freiborg | 52/57 |
| 5,471,801 | A | * | 12/1995 | Kupczyk et al. | 52/57 |
| 5,495,654 | A | * | 3/1996 | Goodhart et al. | 29/527.4 |
| 6,070,384 | A | * | 6/2000 | Chich | 52/518 |
| 6,725,609 | B2 | | 4/2004 | Freiborg et al. | |
| 7,073,295 | B2 | | 7/2006 | Pressutti et al. | |
| 7,124,548 | B2 | | 10/2006 | Pressutti et al. | |
| 2003/0141013 | A1 | * | 7/2003 | Nakasaka | 156/250 |

* cited by examiner

*Primary Examiner* — Jeanette E. Chapman
(74) *Attorney, Agent, or Firm* — 24IP Law Group; Timothy R. DeWitt

(57) ABSTRACT

A hip and ridge shingle having a plurality of sections that may be folded onto one another and secured in folded positions, the shingle being capable of being folded into a plurality of different configurations such as a bullnose configuration and a straight edge configuration.

13 Claims, 5 Drawing Sheets

MULTI-CONFIGURATION HIP AND RIDGE SHINGLE

CROSS-REFERENCE TO RELATED APPLICATIONS

The present application claims the benefit of the filing date of U.S. Provisional Patent Application Ser. No. 61/255,880 filed by the present inventors on Oct. 29, 2009.

The aforementioned provisional patent application is hereby incorporated by reference in its entirety.

STATEMENT REGARDING FEDERALLY SPONSORED RESEARCH OR DEVELOPMENT

None.

BACKGROUND OF THE INVENTION

1. Field of the Invention

The present invention relates generally to hip and ridge shingles for covering the hip and ridge connections on the pitched roof of buildings and houses, and more specifically, to a novel design of a hip and ridge roofing shingle capable of being transformed between a plurality of configurations such as a bull-nose configuration and straight edge configuration.

2. Brief Description of the Related Art

The building industry commonly uses hip and ridge shingles to cover the hips and ridges of various building structures. Conventional hip and ridge shingles have configurations that allow them to cover angled areas of a roof structure. Several asphalt ridge shingles of various shapes and folding patterns have been proposed for peaks of pitched or gabled roofs to provide for water-impermeability and pleasing appearance. For example, U.S. Pat. No. 3,913,294 discloses a tapered asphalt ridge cover comprising a plurality of folds perpendicular to, and approximately midway down the longitudinal axis of the ridge cover with a fold at the front and to produce a small lip with asphalt adhesive on the lower surface of the front end. Another example is disclosed in U.S. Pat. No. 5,247,771, which discloses a ridge cover with first and second tapered portions in which the cover is formed by folding the unit such that the second tapered portion overlaps the first tapered portion. Yet another example is disclosed in U.S. Pat. No. 5,365,711, which teaches a ridge cover composed of a particular composition containing a flexibility adhesive in which the roofing sheet is folded back on itself twice in the intermediate portion of the sheet in order to form a thickened portion midway the length of the sheet with inner sections extending forwardly and rearwardly from the thickened portion. The ridge cover further comprises a T-shaped slit extending through the thickened portion of the unit.

SUMMARY OF THE INVENTION

In a preferred embodiment, the present invention is a hip and ridge shingle configurable into a plurality of configurations. The shingle has a plurality of sections with each section having a top side and an underside opposite the topside. The shingle comprises a base section, a thickness section adjacent and connected to the base section, a first folding section adjacent and connected to the base section opposite the thickness section and a second folding section adjacent and connected to the first folding section opposite the first folding section. The shingle may further comprise a perforation or other means for facilitating folding along at least a portion of the connection between the base section and the thickness section to facilitate folding of the thickness section onto the base section. The shingle may further comprise a slot in the thickness section and/or a sealant on the underside of the base section. The sealant may comprise a plurality of strips of sealant and, for example, may be DLA sealant. The base section may have a first portion having a first width and a second portion having a second width, wherein the first width is greater than the second width. The shingle may further comprise a slot extending from the base section across the first folding section and into the second folding section. Still further, the shingle may comprise a plurality of slots in the first folding section for permitting sealant on the underside of the base section to drip through to contact the topside of the second folding section when the shingle is folded. The shingle may have a perforation along at least a portion of the connection between the base section and the thickness section to facilitate folding of the thickness section onto the base section, a perforation along at least a portion of the connection between the first folding section and the second folding section to facilitate folding of the first and second folding sections onto one another, and a perforation along at least a portion of the connection between the base section and the first folding section to facilitate folding of the first folding section onto the base section.

In another embodiment, the present invention is a method for configuring a hip and ridge shingle having a base section, a thickness section, a first folding section and a second folding section wherein each the section has a granular side and an underside. The method comprises the steps of folding the thickness section onto a first portion of the base section, folding the first folding section and the second folding section together to form a combined folding section, folding the combined folding section onto a second portion of the base section, folding the second portion of the base section onto the thickness section for form a bull-nose edge and partially folding the shingle along a longitudinal axis to form the shingle into an A-shape such that the granular side of the second portion of the base section is exposed on an underside of the A-shape. The method may further comprise the steps of flattening the shingle from an A-shape to a flat shape, unfolding the second portion of the base section off of the thickness section, folding the second portion of the base section in an opposite direction to place the second portion of the base section adjacent the granular side of the first portion of the base section and partially folding the shingle along a longitudinal axis to form the shingle into an A-shape such that the granular side of the second folding section is on an outside of the A-shape.

In yet another embodiment, the present invention is a hip and ridge shingle configurable into a plurality of configurations, the shingle having a plurality of sections with each section having a granular side and an underside. The shingle comprises a base section, a thickness section having connected to a first edge of the base section, a first folding section having a first edge connected to a second edge of the base section and a second folding section connected to a second edge of the first folding section. The underside of the thickness section is adjacent a first portion of the underside of the base section and the granular side of the second folding section is adjacent the granular side of the first folding section. The underside of the first folding section may adjacent to the underside of a second portion of the base section and the granular side of the second folding section is adjacent to the granular side of the thickness section. Alternatively, the granular side of the second portion of the base section is adjacent the granular side of the first portion of the base section.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the present invention and the advantages thereof, reference is now made to the following description and the accompanying drawings, in which.

DETAILED DESCRIPTION OF THE PREFERRED EMBODIMENTS

Figure 1:
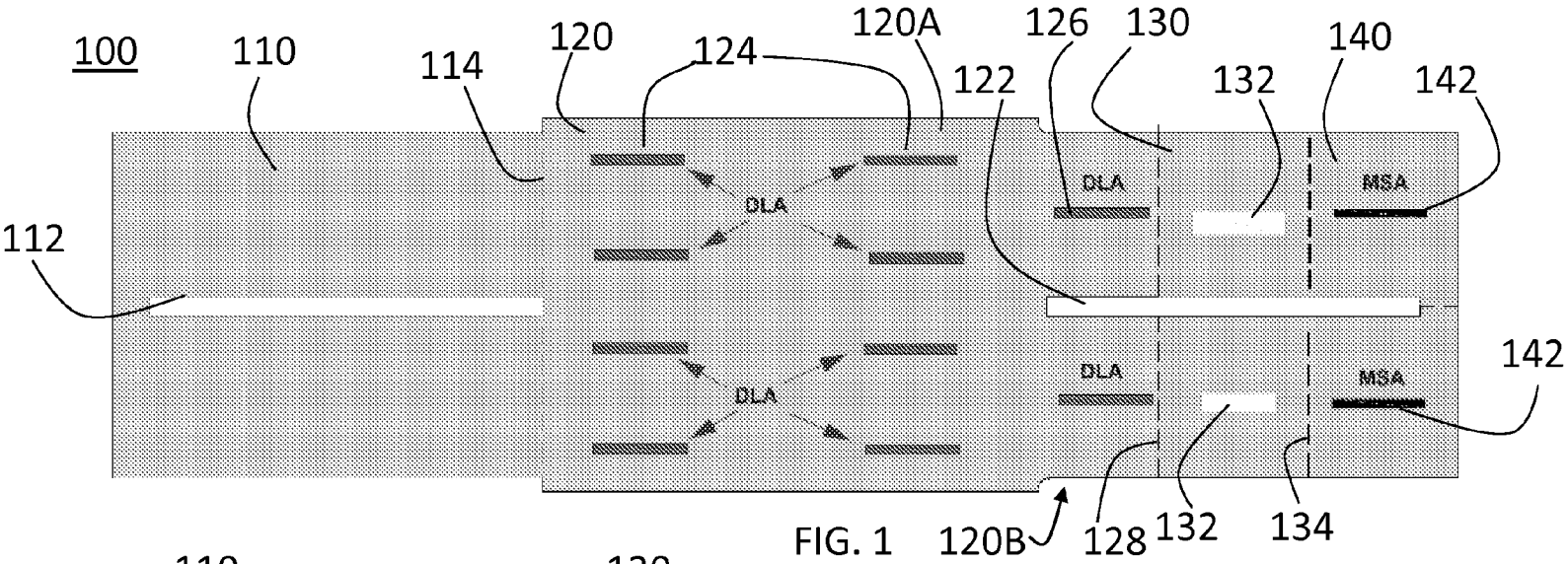
FIG. 1 is a plan view of the underside of hip and ridge shingle in accordance with a preferred embodiment of the present invention prior to being folded.
Figure 2:
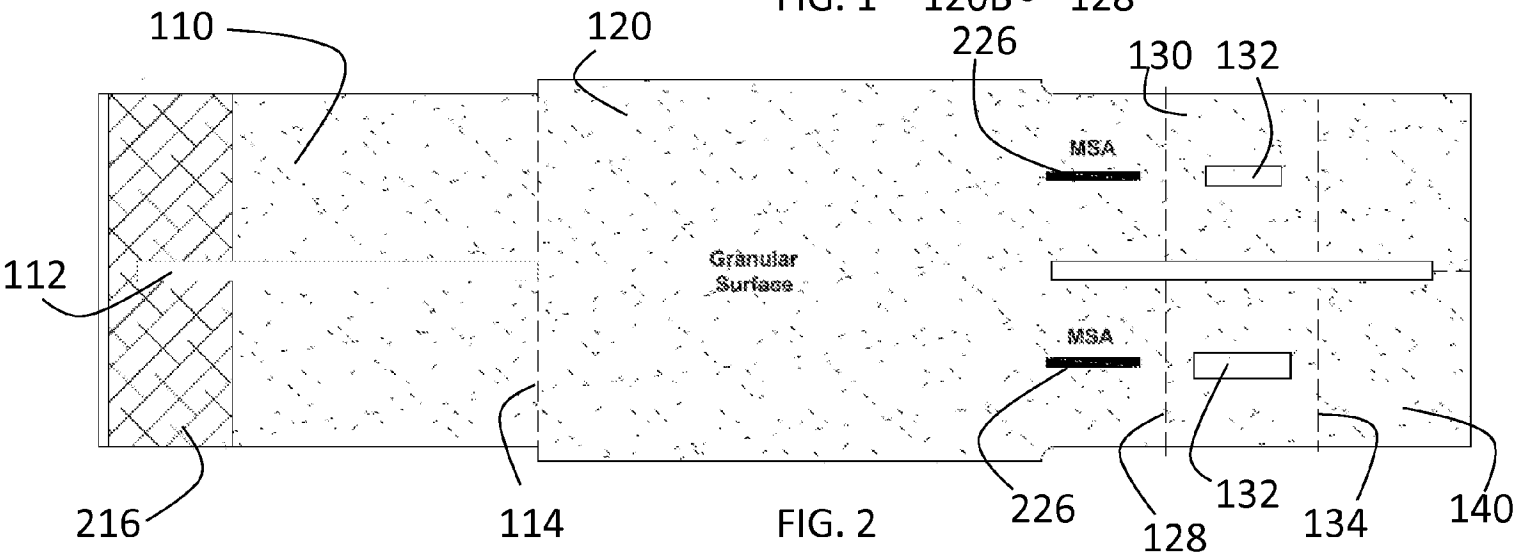
FIG. 2 is a plan view of the granular surface side, or top, of a hip and ridge shingle in accordance with a preferred embodiment of the present invention prior to being folded.

A preferred embodiment of the present invention is described with reference to FIGS. 1-6. FIGS. 1 and 2 illustrate a die cut hip and ridge shingle in accordance with a preferred embodiment of the present invention that has been die cut in a roll form or sheet form manufacturing process. FIG. 1 shows the bottom or underside of the hip and ridge shingle while FIG. 2 shows the top or granular surface side. The shingle may be made from an asphalt-based shingle material or from other materials such as those having SBS rubber content. During the manufacturing process, hot asphalt heads apply sealant to the shingle material.

As shown in FIG. 1, while the shingle in the illustrated preferred embodiment is formed as a shingle integrated unit, the shingle may be considered to have four sections denoted by fold lines, which in the preferred embodiment include perforations to facilitate the folding process. Beginning from the left side of FIG. 1, the shingle 100 has a "thickness" section 110, a base section 120, a first fold section 130, and a second fold section 140.

The thickness section 110 has a slot 112 cut therein to ease the folding process that will be described below. The thickness section 110 adds a desirable thickness to the product when it is folded into its various configurations.

The base section 120 has a sealant applied thereto. In the preferred embodiment, DLA sealant is applied in a pattern of strips 124. Other sealants and other application arrangements may be used with the present invention. The sealant strips 124 serve to secure the thickness section 110 to the base section 120 when the thickness section 110 is folded along perforation line 114 onto the base section 120. While a perforation line 114 is shown in connection with the preferred embodiment, other arrangements, such as with no perforation, a different perforation, or other methods of facilitating folding, may be used with the present invention. The base section 120 further has a slot 122 cut therein that extends across the first folding section 130 and partially into the second folding section 140. Like the slot 112 in the thickness section 110, this slot 122 assists in the folding process described below. Finally, the base section has sealant strips 126 applied near folding or perforation line 128. The sealant strips 126, also DLA sealant in the preferred embodiment, are used to secure the first folding section 130 to the base section 120 when the product is folded into a bullnose configuration.

The first folding section 130 has a pair of slots 132 die-cut therein. The slots 132 permit the sealant in sealant strips 126 to seep through to contact the granular surface side of the second folding section 140 when the product it folded along folding lines or perforations 128 and 134. The second folding section 140 has a pair of MSA sealant strips 142. Depending on the configuration the shingle is folded into, these sealant strips 142 either contact the base section 120 to hold the shingle in a particular folded configuration or contact other shingles on a roof to hold the shingle in position.

Note that the base section 120 has a first larger width portion 120A onto which the thickness section 110 will be folded and a second smaller width section 120B onto which the first and second folding sections 130, 140 will be folded. The width of the thickness section 110 and the first and second folding sections 130, 140 is smaller than the width of the largest portion of the base section 120. These variations in width are provided to reduce or eliminate the visibility of the thickness section 110 and the first and second folding sections 130, 140 when the shingle is installed in one of its final configurations.

Looking now to FIG. 2, which shows the granular surface side of the shingle 100 of a preferred embodiment, the thickness section 110 has release tape 216 on a portion of its granular surface side. The base section 120 has MSA sealant strips 226 on its granular surface side either for contacting adjacent shingles when the shingle is in its final bullnose configuration. In a straight edge configuration, these sealing strips 226 contact an adjacent portion of the granular surface side of base section 120.

Figure 3:
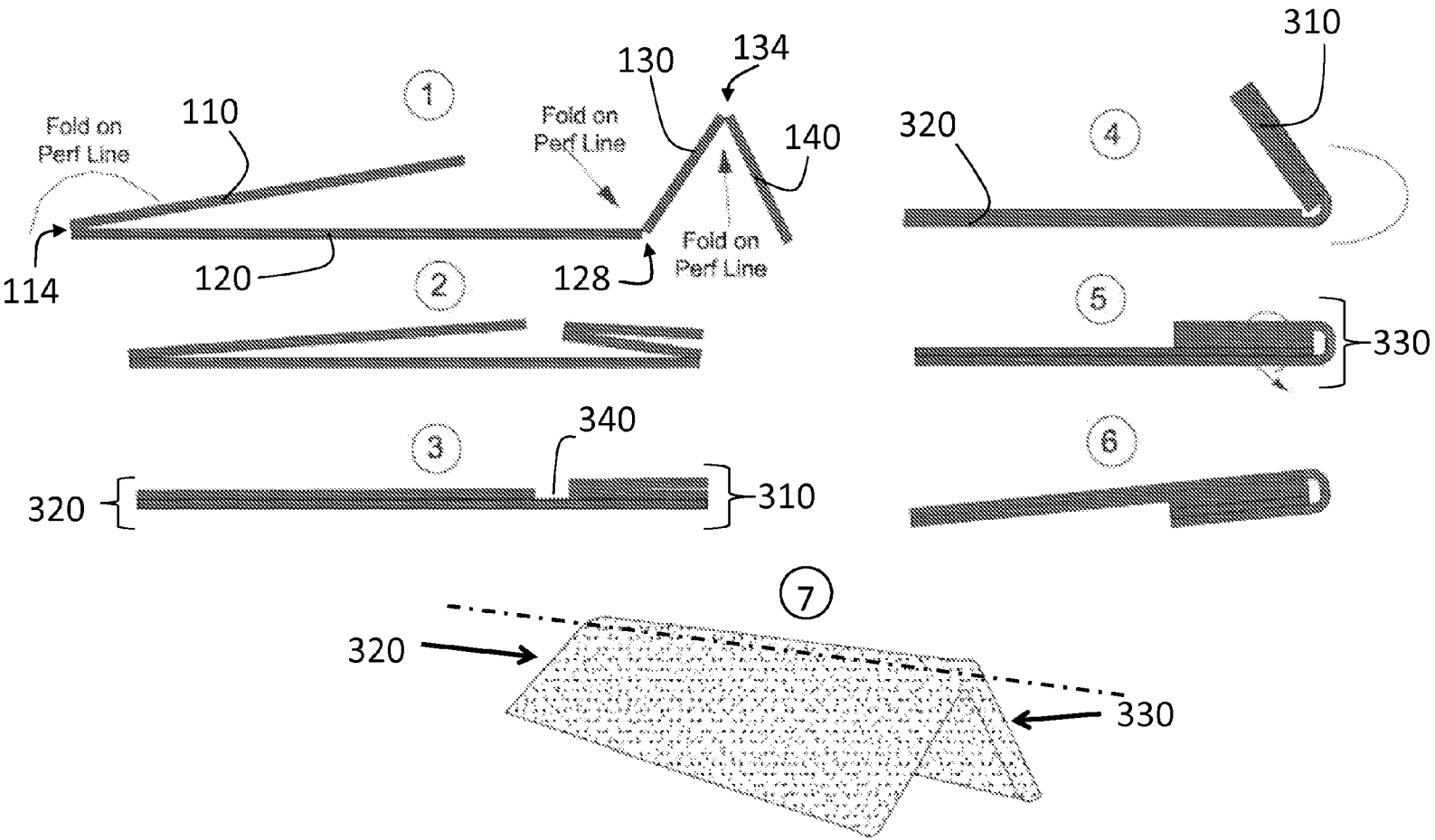
FIG. 3 is a series of side views showing the folding into a bullnose configuration of a hip and ridge shingle in accordance with a preferred embodiment of the present invention.
Figure 5:
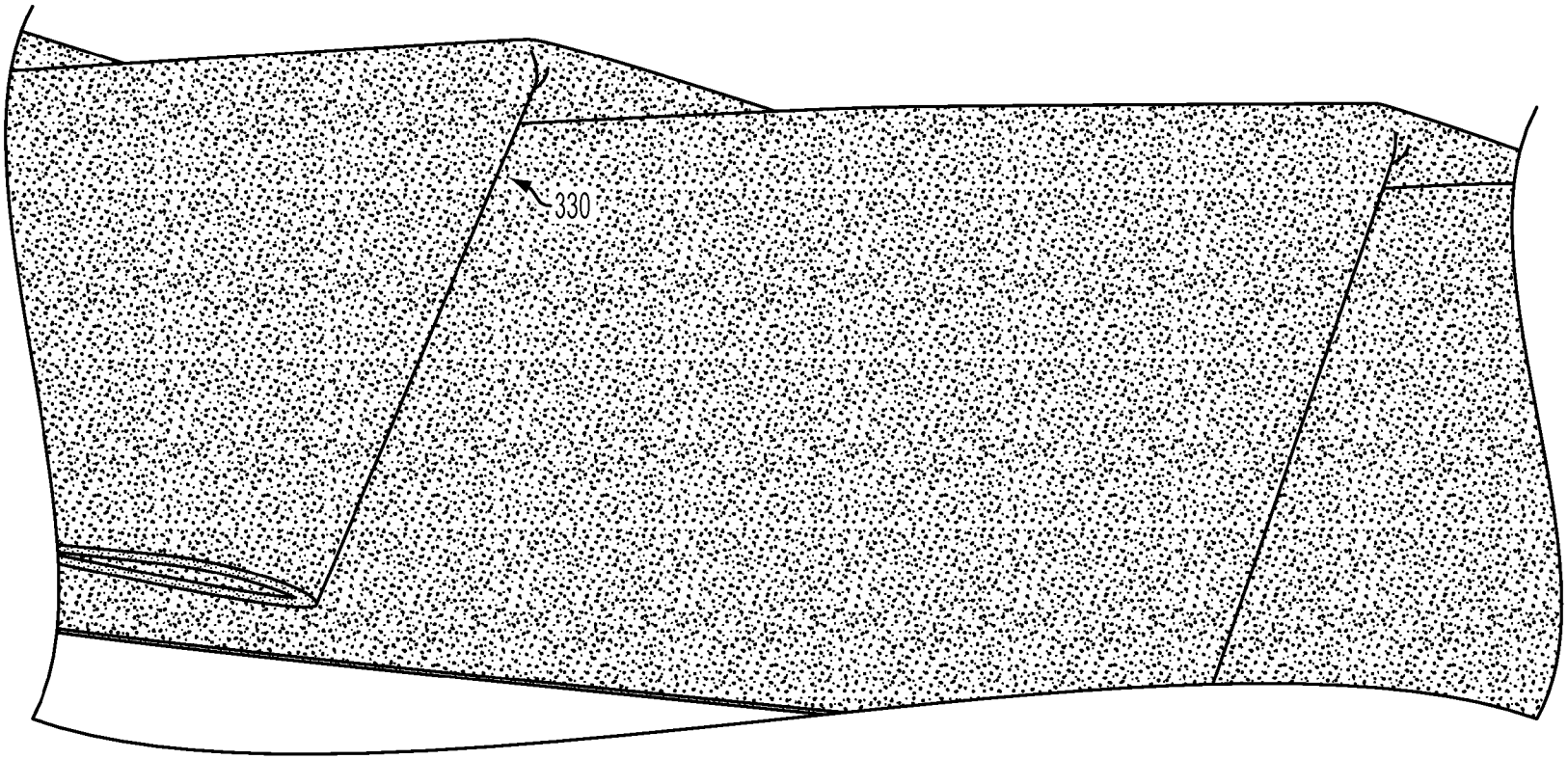
FIG. 5 illustrates the placement of a plurality of hip and ridge shingles relative to one another in accordance with a preferred embodiment of the present invention on a roof when the shingles are in a bullnose configuration.

A method for folding a shingle in accordance with the present invention into a bullnose configuration is illustrated in FIG. 3. As shown in steps 1 and 2, the thickness section 110 is folded along fold line 114 onto the base section 120 such that the undersides of the thickness section 110 and the base section 120 are adjacent to one another and the sealant strips 124 on the base section contact the thickness section 110 and hold it in the folded configuration. The first and second fold sections 130, 140 are folded along fold line 134 such that the granular surface sides of the first and second fold sections are placed adjacent to one another and folded along fold line 128 such that the underside of the first fold section 130 is adjacent the underside of the base section 120. As shown in step 3, these folds create first folded portion 320 comprised of the thickness section 110 and the base section 120 and a second folded portion 310 comprised of the base section 120, the first fold section 130 and the second fold section 140. As shown in step 3, there is a small region 340 of the base section 120 separating the first fold section 320 from the second fold section 310. As shown in step 4, this small separation 340 facilitates the folding of the second fold section 320 onto the first fold section 310 to create a bullnose configuration 330. At the conclusion of steps 1-5, the product is up-side-down, and therefore is rotated in step 6 to a right-side-up position. As shown in step 7, the shingle is then partially folded on a longitudinal axis into a tent or A-shape such that it may be placed onto and secure to the peak or ridge of a roof during construction. FIG. 5 illustrates several shingles in accordance with the preferred embodiment of the invention secured to a ridge while in the bullnose configuration. As shown in FIG. 5, shingles are secured to the ridge such that the bullnose 330 of each shingle rests on an adjacent shingle. The shingles in this configuration typically would be nailed to the roof through the section 320 spaced away from the bullnose 330.

Figure 4:
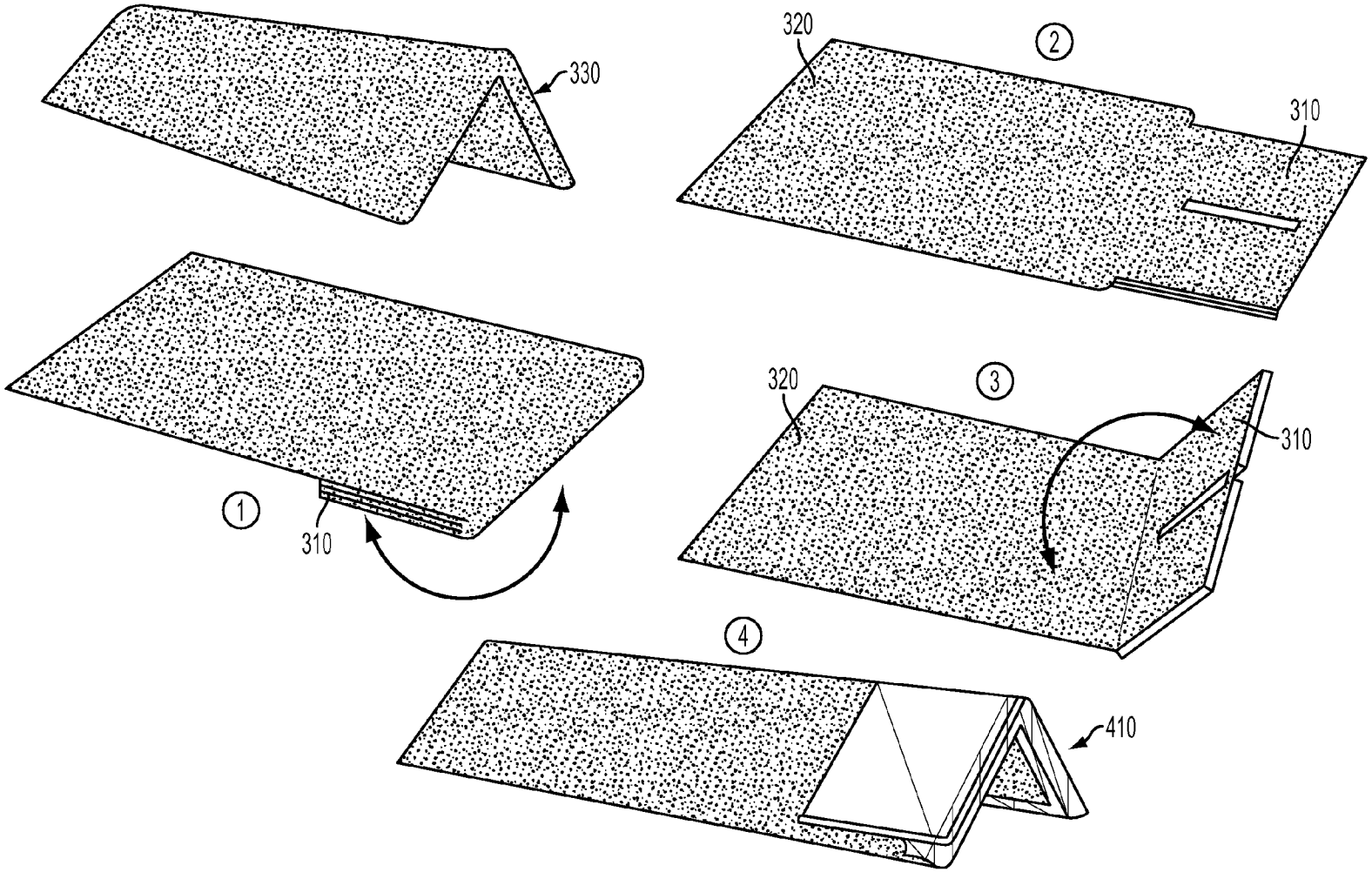
FIG. 4 is a series of side views showing the folding of a hip and ridge shingle in accordance with a preferred embodiment of the present invention from a bullnose configuration into a straight edge configuration.
Figure 6:
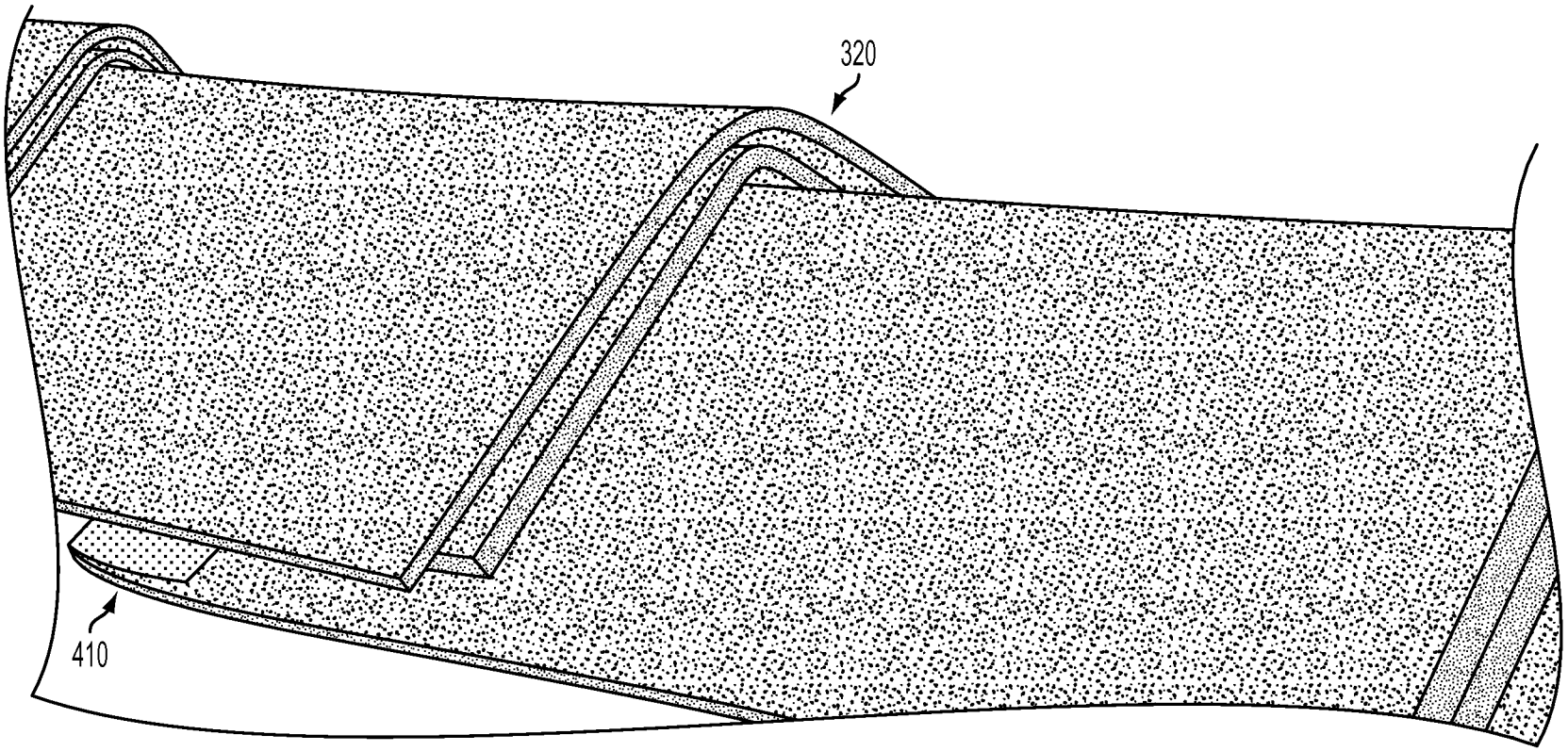
FIG. 6 illustrates the placement of hip and ridge shingles in accordance with a preferred embodiment of the present invention on a roof when the shingles are in a straight edge configuration.

FIG. 4 illustrates the conversion of a shingle of a preferred embodiment from a bullnose configuration into a straight edge configuration. In the upper left corner, the starting point of the shingle in a bullnose configuration is shown. At step 1, the shingle is flattened out from the tent or A-shape final bullnose configuration into the flat configuration shown. At step 2, the section 310 is unfolded to a flat position and then in step 3 is folded the opposite direction such that the granular surface of the first fold section 130 is placed adjacent the granular surface of the base section 120. As shown in step 4, the shingle is then again formed into the tent or A-shaped configuration. The placed of the shingles on a ridge when in the straight edge configuration is shown in FIG. 6. In this configuration, the straight edge of section 320 is on top of an adjacent shingle while the thicker edge 410 is underneath an adjacent shingle. The shingles in this configuration are nailed to the roof through the thicker section 410.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A hip and ridge shingle configurable into a plurality of configurations, said shingle having a plurality of sections with each section having a topside and an underside opposite said topside, comprising:

a base section;

a thickness section adjacent and connected to said base section;

a first folding section adjacent and connected to said base section opposite said thickness section;

a second folding section adjacent and connected to said first folding section opposite said first folding section; and a slot extending from said base section across said first folding section and into said second folding section.

2. A hip and ridge shingle according to claim 1, further comprising a perforation along at least a portion of the connection between the base section and the thickness section to facilitate folding of said thickness section onto said base section.

3. A hip and ridge shingle according to claim 1, further comprising a means for facilitating folding of said thickness section onto said base section.

4. A hip and ridge shingle according to claim 1, wherein said further comprising a slot in said thickness section.

5. A hip and ridge shingle according to claim 1, further comprising a sealant on said underside of said base section.

6. A hip and ridge shingle according to claim 5, wherein said sealant on said base section comprises a plurality of strips of sealant.

7. A hip and ridge shingle according to claim 6, wherein said sealant comprises a DLA sealant.

8. A hip and ridge shingle according to claim 1, wherein said base section has a first portion having a first width and a second portion having a second width, wherein said first width is greater than said second width.

9. A hip and ridge shingle according to claim 1, further comprising a plurality of slots in said first folding section for permitting sealant on the underside of said base section to drip through to contact the topside of said second folding section when the shingle is folded.

10. A hip and ridge shingle according to claim 1, further comprising:

a perforation along at least a portion of the connection between the base section and the thickness section to facilitate folding of said thickness section onto said base section;

a perforation along at least a portion of the connection between said first folding section and said second folding section to facilitate folding of said first and second folding sections onto one another;

a perforation along at least a portion of the connection between the base section and the first folding section to facilitate folding of said first folding section onto said base section.

11. A hip and ridge shingle configurable into a plurality of configurations, said shingle having a plurality of sections with each section having a granular side and an underside, comprising:

a base section;

a thickness section having connected to a first edge of said base section;

a first folding section having a first edge connected to a second edge of said base section;

a second folding section connected to a second edge of said first folding section; and a plurality of slots in said first folding section for permitting sealant on the underside of said base section to drip through to contact the topside of side second folding section when the shingle is folded;

wherein, said underside of said thickness section is adjacent a first portion of said underside of said base section and said granular side of said second folding section is adjacent said granular side of said first folding section.

12. A hip and ridge shingle according to claim 11, wherein said underside of said first folding section is adjacent to said underside of a second portion of said base section and said granular side of said second folding section is adjacent to said granular side of said thickness section.

13. A hip and ridge shingle according to claim 11, wherein said granular side of said second portion of said base section is adjacent said granular side of said first portion of said base section.

* * * * *